US005976329A

United States Patent [19]

Bock et al.

[11] Patent Number: 5,976,329

[45] Date of Patent: Nov. 2, 1999

[54] GALVANIC DEPOSITION CELL WITH AN ADJUSTING DEVICE

[75] Inventors: Michael Bock, Bielefeld; Wittold Krawczyk, Gütersloh; Klaus Prenzel, Gütersloh; Rudolf Opitz, Gütersloh, all of Germany

[73] Assignee: Sono Press Produktionsgesellschaft Fur Ton-Und Informationstrager MBH, Gutersloh, Germany

[21] Appl. No.: 08/973,024

[22] PCT Filed: Oct. 9, 1997

[86] PCT No.: PCT/EP97/01639

§ 371 Date: Mar. 13, 1998

§ 102(e) Date: Mar. 13, 1998

[87] PCT Pub. No.: WO97/37061

PCT Pub. Date: Oct. 9, 1997

[30] Foreign Application Priority Data

Apr. 1, 1996 [EP] European Pat. Off. ..... 96105230

[51] Int. Cl.[6] ..... C25D 17/00

[52] U.S. Cl. ..... 204/212; 204/287; 204/225

[58] Field of Search ..... 204/225, 224 R, 204/287, 297 R

[56] References Cited

U.S. PATENT DOCUMENTS

| | | | |
|---|---|---|---|
| 3,573,176 | 3/1971 | Laznovsky | 204/224 R |
| 4,120,771 | 10/1978 | Dewallans | 204/225 |
| 4,126,533 | 11/1978 | Lukyanchikov | 204/224 R |
| 4,162,951 | 7/1979 | Tscherwitschke et al. | 204/13 |
| 4,187,154 | 2/1980 | Dewallens | 204/5 |
| 4,539,079 | 9/1985 | Okabayashi | 204/5 |
| 5,597,460 | 1/1997 | Reynolds | 204/212 |
| 5,670,034 | 9/1997 | Lowery | 204/143 |

FOREIGN PATENT DOCUMENTS

| | | |
|---|---|---|
| 0058649 | 8/1982 | European Pat. Off. . |
| 0131857 | 1/1985 | European Pat. Off. . |
| 4005-519 | 7/1970 | Japan . |

*Primary Examiner*—Donald R. Valentine
*Assistant Examiner*—Erica Smith-Hicks
*Attorney, Agent, or Firm*—Howard & Howard

[57] ABSTRACT

This invention relates to an apparatus for the galvanic deposition of a metal layer on a substrate. The apparatus comprises a container for holding an electrolyte, and an anode container filled with an anode material and having an essentially planar exit surface for the metal ions of the anode material. A substrate holder is connected to a drive shaft that is supported in a drive means mounted on a cover of the container. The cover is pivotable about a pivoting axis of a pivoting means mounted on the side of the container opposite to the anode container. An adjusting plate permits the substrate surface to be adjusted with respect to the exit surface of the anode container facing the substrate surface. The invention provides a more uniform deposition of metal ions on the substrate surface.

31 Claims, 9 Drawing Sheets

GALVANIC DEPOSITION CELL WITH AN ADJUSTING DEVICE

BACKGROUND OF THE INVENTION

The invention generally relates to an apparatus for the galvanic deposition of a metal layer on a substrate and, more particularly, to a galvanic deposition apparatus having an adjustable substrate holder and anode exit surface.

An apparatus of this kind is used, for example, for the galvanoplastic production of compression tools or molds, especially ones made of nickel. These compression tools are used for the compression molding or injection molding of disks, such as compact disks (CDs), laser vision disks and other information-carrying disks. The above-mentioned molds, which include original molds, as an example, molds known as a "glass master", as well as reproductions thereof, are intermediate molds for producing the compression tools. The surface of the molds carry information in the form of a relief or recess. The surface structure is transferred to the compression tool by means of galvanoplastic reproduction. The information contained in this surface structure is imprinted onto the surface of a plastic material when using the compression tool for injection molding or compression molding. In optical disks, such as compact disks, the relief structure modulates the light of a laser beam such that the information imprinted on the surface of the disk can be read.

To produce the compression tools or the molds, a metal layer, usually nickel, is deposited on a substrate that is either an insulating substrate like glass plus a thin electrically conductive layer, or a metal substrate, comprising for example nickel. In either case, the substrate surface has a relief-like structure that contains the information to be read. The smallest information unit, called a "pit," has a spatial wave-length in the micrometer range. The pits are arranged in information tracks and the distance between adjacent information tracks is also in the micrometer range. Since the substrate surface may contain several billion ($10^9$) information units, and these corresponding fine structures in the micrometer range have to be transferred to the metal layer, the galvanic metal deposition process has to meet very high standards. The deposited metal layer should be extremely small grained and free of tension and the thickness of the deposited layer should be relatively large. For example, the compression tool produced by metal deposition for producing compact disks should have a thickness of 295 $\mu$m±5 $\mu$m. In addition, the deposition process should be carried out at a high speed. Moreover, the apparatus for galvanic deposition should be small in size and simple in its operation.

Another important requirement when creating galvanoplastic metal layers on a substrate is that the thickness of the deposition layer should be uniform across the entire substrate surface. The thickness should vary only within close limits. If these limits are not met, the optical disks produced by means of this metal layer will be of a lesser quality.

A galvanic deposition apparatus of the type described above is known from EP-A-O 058 649. The apparatus includes an anode container filled with an anode material and inclined with respect to a vertical line. The exit surface of the anode container is essentially parallel to a substrate surface. The substrate is supported by a substrate holder driven by a shaft. But, the metal layer deposited on the substrate by means of this known apparatus shows considerable variations in the thickness of the layer across the substrate surface.

Thus, it is an object of the present invention to provide an apparatus for the galvanic deposition of a metal layer in which the variations in the thickness of the layer is reduced across a relatively large surface of the substrate.

SUMMARY OF THE INVENTION

In general terms, this invention provides a means for adjusting the substrate surface relative to the anode container exit surface and for adjusting the plane of the exit surface.

The apparatus comprises a container for holding an electrolyte and an anode container that is filled with an anode material and that has a substantially planar exit surface for the metal ions of the anode material. The metal ions are deposited on a substrate surface that faces the anode container. The substrate serves as a cathode. The substrate surface is inclined with respect to a vertical line and arranged substantially parallel to and at a distance from the exit surface of the anode container. The apparatus further includes a substrate holder connected to a driven shaft extending in a direction perpendicular to the substrate surface. The driven shaft is supported by a drive means on a cover of the container. The cover is pivotably mounted on a pivoting axis of a pivoting means that is mounted on a side of the container that is opposite to the anode container.

The invention is based on the concept that a non-homogeneous distribution of electric current lines in the space between the anode container and the substrate surface, which serves as the cathode, is essentially responsible for the variation in the thickness of the deposition layer. It is desirable that the current lines run as uniformly and homogeneously as possible in the form of parallel rays between the exit surface of the anode container and the substrate surface. Since, in practice, the electric resistance along lines between the exit surface and the substrate surface is not constant, the homogeneity of the current line distribution is also impaired, and the metal layer grows to different thicknesses on the substrate surface. By changing the position of the substrate surface relative to the position of the exit surface of the anode container for example by changing the distance between them, or by changing the inclination of the surfaces with respect to each other, etc., it is possible to influence the electrical resistance along lines between the surfaces and thus to influence the distribution of the current lines. In this manner, the distribution of the current lines on the substrate surface can be homogenized, which will also result in a more uniform growth of the metal layer.

Theoretically, it is possible to change and adjust both surfaces simultaneously with respect to each other. In practice, however, it is advantageous to hold either the substrate surface or the exit surface in a stable position and to change the position of the other surface. It is preferred to use the substrate surface as the adjustable surface, because this surface is connected through the substrate holder to the cover, which prevents introduction of foreign matter into the container holding the electrolyte. The position of this cover can be adjusted from outside the container, or the position of the substrate holder attached to the cover can be easily adjusted from outside the container.

A preferred embodiment of the invention is characterized in that the pivoting axis of the cover lies in a plane which is parallel to the axis of the driven shaft and intersects a clamping plate of the substrate holder. When closed the cover is shiftable towards the anode container which further reduces the distance between the substrate surface and the exit surface of the anode container.

In practice, it has been shown that when the distance between the substrate surface and the exit surface of the anode container is reduced, the deposition speed of the metal ions increases. The reduced distance decreases the electrical resistance along straight lines connecting the substrate surface and the exit surface. As a result, although the electric potential between the anode and the cathode remains unchanged, the current and thus the number of metal ions transported per unit time is increased. When the distance between the substrate and the anode container is reduced, a non-homogeneous current line distribution adversely effects the uniformity of the thickness of the deposited layer. In the present invention, the distribution of current lines is homogenized by including an insulating or guiding shield having an aperture and positioning it between the anode container and the substrate. Since this shield is arranged near the substrate, care must be taken to prevent the clamping plate holding the substrate from colliding with the shield during its pivoting motion upon opening the cover. The features of the cover, described above, ensure that when the cover is closed the distance between the substrate surface and the exit surface of the anode container is small and upon opening the cover, the cover can be pulled in a direction away from the anode container to thereby increase the distance between the substrate surface and the exit surface. So, when pivoting the cover, the edge of the clamping plate thus passes the shield at a sufficient distance therefrom.

Another aspect of the invention which is important for achieving a homogeneous thickness of the layer on the substrate surface relates to the anode container. As already mentioned above, it is generally desirable that the exit surface for metal ions is in a plane parallel to the substrate surface. The anode container contains the material to be deposited in the form of small material pieces, such as small pieces of nickel. While the galvanic deposition cell is in operation, the anode container is refilled with pieces of material in order to maintain a high filling level inside the anode container. This is necessary to ensure that the titanium material, of which the anode container is made, does not dissolve in the electrolyte but remains passivated.

It has been found that the known anode containers become deformed by bulging or rippling after being in use for only a short while. This deformation is presumably due to the densification of the anode material which is eroded during the deposition process. A deformation of the front surface of the anode container, which contains the exit surface, changes the current line distribution between the exit surface and the substrate surface, resulting in variations of the thickness of the deposition layer across the surface of the substrate.

The present invention solves this problem by arranging a spacer made of titanium between a rear wall and the front wall of the anode container.

This spacer ensures that the exit surface is kept at a constant distance from the rear wall of the anode container. So, the parallel plane arrangement of the exit surface relative to the substrate surface is maintained even if there is a densification of the anode material during operation.

Another aspect of the invention relates to the supply of electrical power to the anode container. To achieve a high deposition speed, currents of a considerable amperage, such as 90 amperes, have to be supplied to the anode container. Therefore, a secure electrical contact must be assured. Further, the anode conductor and the electrical contact between the anode conductor and the anode container have to be arranged in the electrolyte container in such a way that the influence exerted by current-carrying elements on the distribution of current lines in the electrolyte is minimized.

It is known from EP-A-O 058 649 to arrange the anode conductor in a lower region of the electrolyte container and to provide a set of terminals as the electrical contact. To reduce contact resistance, the contact pressure is often generated by a screw connection. Such a screw connection is susceptible to electrolyte incrustations, which may result in incorrect positioning of the nuts or the screws causing damage to the threads and making the connection unfit for use. The connection between the contact and the anode conductor then lacks the required contact pressure so that there is overheating of the contact point if there is a strong current flow, and the galvanic deposition cell may even be destroyed in the neighborhood of the contact point by melting plastic. Thus, it is necessary to provide an apparatus for the galvanic deposition of a metal layer on a substrate in which the supply of electrical power to the anode container is effected in a safe and reliable manner and the anode container can be mounted easily without complicated manipulations.

According to the present invention, the contact is designed as a clip connector (multiple contact strip) which is attachable to and detachable from the anode conductor and which can be brought into spring-loaded contact with the anode conductor. The clip connector provides the required contact pressure so that there are no loose contact points having the drawbacks mentioned above. The clip connector can easily be slipped onto the anode conductor. This makes it possible to quickly exchange the anode container without the necessity of time-consuming assembly steps. Due to the elastic pressure of the clip connector, the contact point is cleaned by the spring pressure of the clip connector every time the clip connector is slipped onto the anode conductor. This prevents the formation of electrolyte incrustations at the contact point, and a low contact resistance is ensured.

These and other features and advantages of this invention will become more apparent to those skilled in the art from the following detailed description of the presently prepared embodiment. the drawings that accompany the embodiments of the invention will now be explained in detail in connection with the accompanying drawings, wherein:

DETAILED DESCRIPTION OF THE PREFERRED EMBODIMENT

Figure 1:
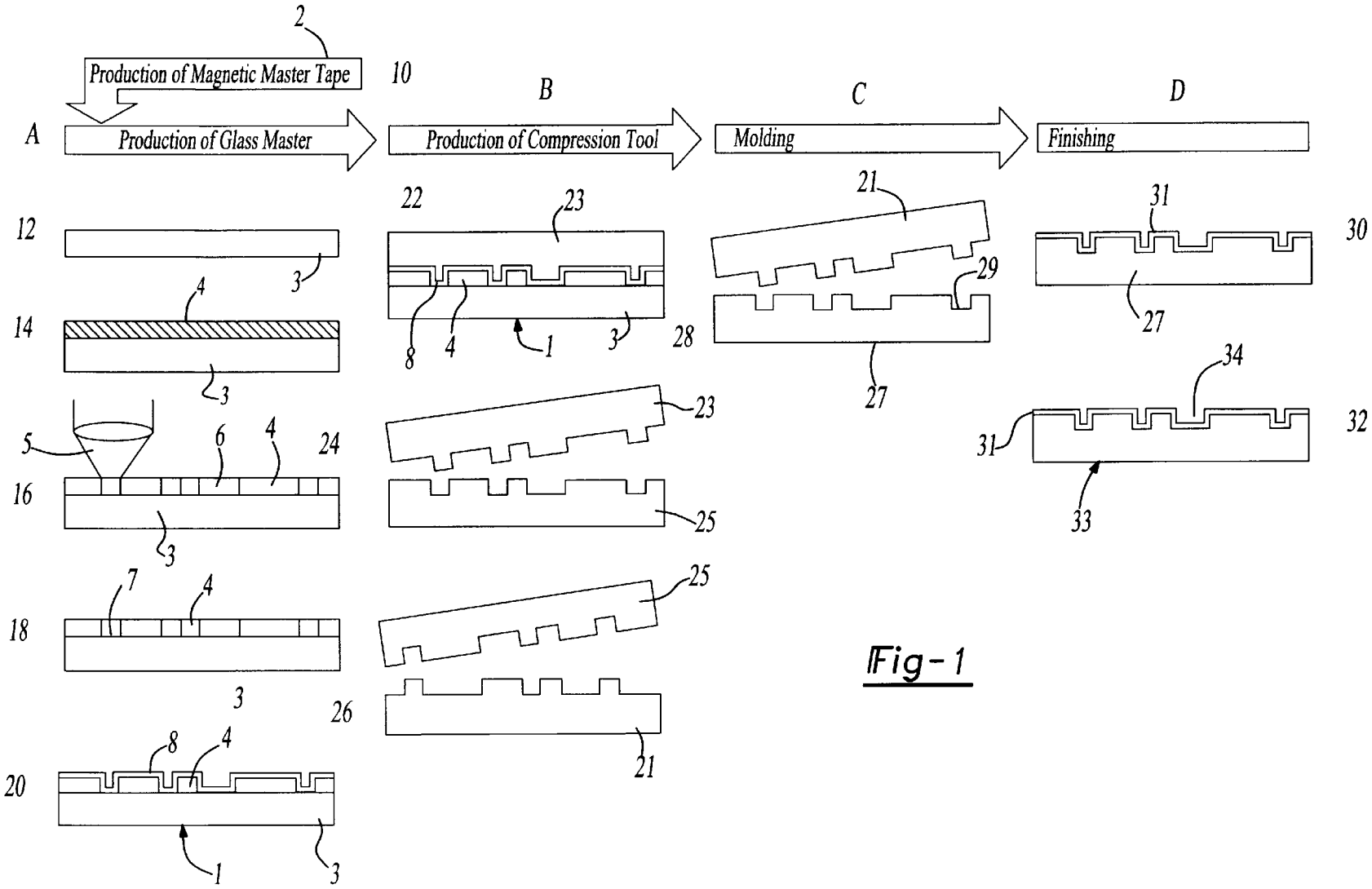
FIG. 1 is a schematic view of an application of the invention, to the production of a compact disk by metal deposition.

FIG. 1 shows, schematically, application of the invention to the manufacturing of a compact disk for audio applications. Compact disks are created using molds that have a metal layer created by galvanic deposition in an apparatus designed according to the invention. The quality of this metal layer is determinative for the quality of the reproduction of the audio signals stored on the compact disk.

The manufacturing steps may be grouped into four stages A, B, C, D. Stage A comprises the manufacturing of a glass master 1, B comprises the manufacturing of a compression tool 21, C comprises the molding of a compact disk 33 and D comprises the finishing of the compact disk 33.

The starting point for manufacturing a compact disk 33 is the creation of a magnetic master tape 2 (step 10), wherein audio information is stored digitally on a high precision magnetic tape. The glass master 1 is created by polishing a glass disk 3 and then applying a thin layer of a photoresist 4 to one surface of the glass disk (steps 12 and 14). Then the photoresist 4 is exposed to a focused laser beam 5 which is modulated by the digital information on the magnetic master tape 2 (step 16). The exposed portions 6 of the photoresist 4 are then removed, leaving a relief-like photoresist 4 structure on the glass disk 3 (step 18). This structure contains, in the form of pits 7, the digital information taken from the magnetic master tape 2. The relief-like surface structure is then coated with a thin electrically conductive layer 8, for example a metal like nickel (step 20).

In stage B, the compression tool 21 is produced. In step 22, a first metal mold 23, the so-called "father," is produced in a galvanic deposition apparatus (not shown) designed according to the invention by depositing a thick nickel layer, preferably having a thickness of about 500 $\mu$m, on the thin electrically conductive layer 8 of the glass master 1 by a galvanic deposition process. The father 23 has a relief structure that is complementary to the glass master 1. The father 23 may be used directly as a tool for manufacturing compact disks. Preferably, the father 23 is used to create a second mold 25, known as a "mother", that consists of nickel, in another galvanic deposition process (step 24). Afterwards, the compression tool 21 is then formed from the mother 25 as a negative copy in still another galvanic deposition process (step 26). The compression tool, produced in this step is also called a "son" or "stamper" and is used as the compression tool for mass production of compact disks. It should be noted that it is of course possible to produce a number of mothers 25 or sons 21 which can be used for the production of compact disks in different production plants.

The subsequent molding of the compact disk 33 in stage C comprises either an injection molding process or a compression molding process during which the relief structure of the compression tool 21 is transferred onto a plastic material 27 (step 28). The digital information originally contained on the magnetic master tape 2 (step 10) is now contained on the disk-shaped plastic material 27 as a relief structure or so-called pit structure 29, wherein one pit is the smallest unit of information and has the form of a recess in the surface of the plastic material 27.

The subsequent finishing of the compact disk 33, stage D, comprises coating the surface of the plastic material 27 with a thin reflection layer of aluminum 31 in a sputter process as is known in the art. Due to the reflection layer of aluminum 31, a scanning laser beam in a compact disk layer is modulated while scanning the compact disk 33 and the original audio information is recovered. In the final manufacturing step 32, the compact disk 33 is coated with a transparent protective layer 34 to protect the reflection layer 31 from damage and corrosion.

In the foregoing example, a description of the steps for producing an audio compact disk (audio CD) has been given. Data compact disks, laser vision disks and other optical disks with information stored in a pit structure 29 are produced in an identical or in a similar manner.

The relief-like pit structure 29 on the reflection layer 31 of the compact disk 33 has extremely small dimensions. In a typical track of a compact disk 33, the width of a pit is approximately 0.5 $\mu$m, the depth is approximately 0.1 $\mu$m and the length varies between 1 to 3 $\mu$m. The distance between tracks is approximately 1.6 $\mu$m. In view of the smallness of these structures, it is understandable that the various galvanic deposition steps for producing the father 23, mother 25, and son 21 have to meet very strict standards, especially with regard to the uniformity of the thickness of the metal layer across their entire surface. A large variation in the metal layer thickness in combination with the injection process for producing the compact disk 33 leads to problems in removing the disk 33 from the mold and makes it difficult to apply the protective layer 34. Furthermore, during the high speed rotation of a compact disk 33 created from non-uniform mold, the optical scanning sensor cannot compensate sufficiently for the variations in height occurring on the compact disk 33, and there may be a loss of information.

Figure 2:
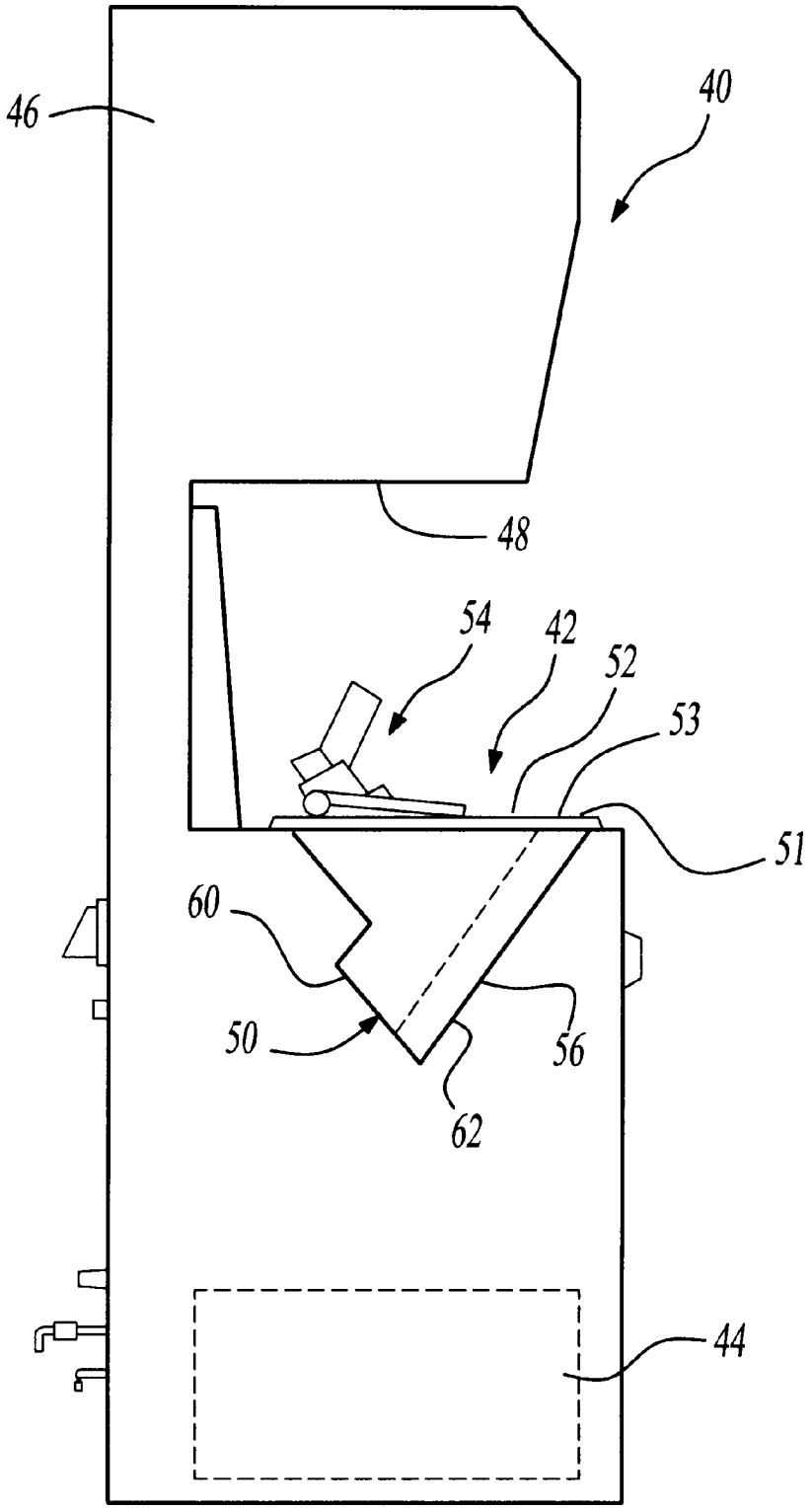
FIG. 2 is a view of a galvanic machine including a galvanic cell.

FIG. 2 shows a side view of a galvanic machine 40 including a galvanic deposition cell 42. The various molds, such as fathers 23, mothers 25, and sons 21 are formed in the galvanic deposition cell 42 by galvanic deposition of nickel metal. The galvanic machine 40, includes a cleaning unit 44 for cleaning and filtering an electrolyte (not shown). A head portion 46 contains an electric control and a set of power units (not shown) for controlling the galvanic process. A series of rectifiers (not shown) for producing the required high direct current are controlled by a computer (not shown). The components that are in contact with the electrolyte are made of polypropylene plastic material or titanium. A clean room filter 48 is arranged above the galvanic deposition cell 42. The galvanic deposition cell 42 includes a container 50 having two outer walls, 60 and 62, which are essentially inclined with respect to a vertical line. The other outer walls (not shown) extend vertically. A drive means 54 is arranged on a cover 52 of the container 50. This drive means 54 will be described in further detail below. A detachable cover plate 51 is provided adjacent to the cover 52 and separated from it by a partition gap 53. Within the container 50, there is an anode container 56 made of titanium which is accessible to an operator when the cover plate 51 is open.

Figure 3:
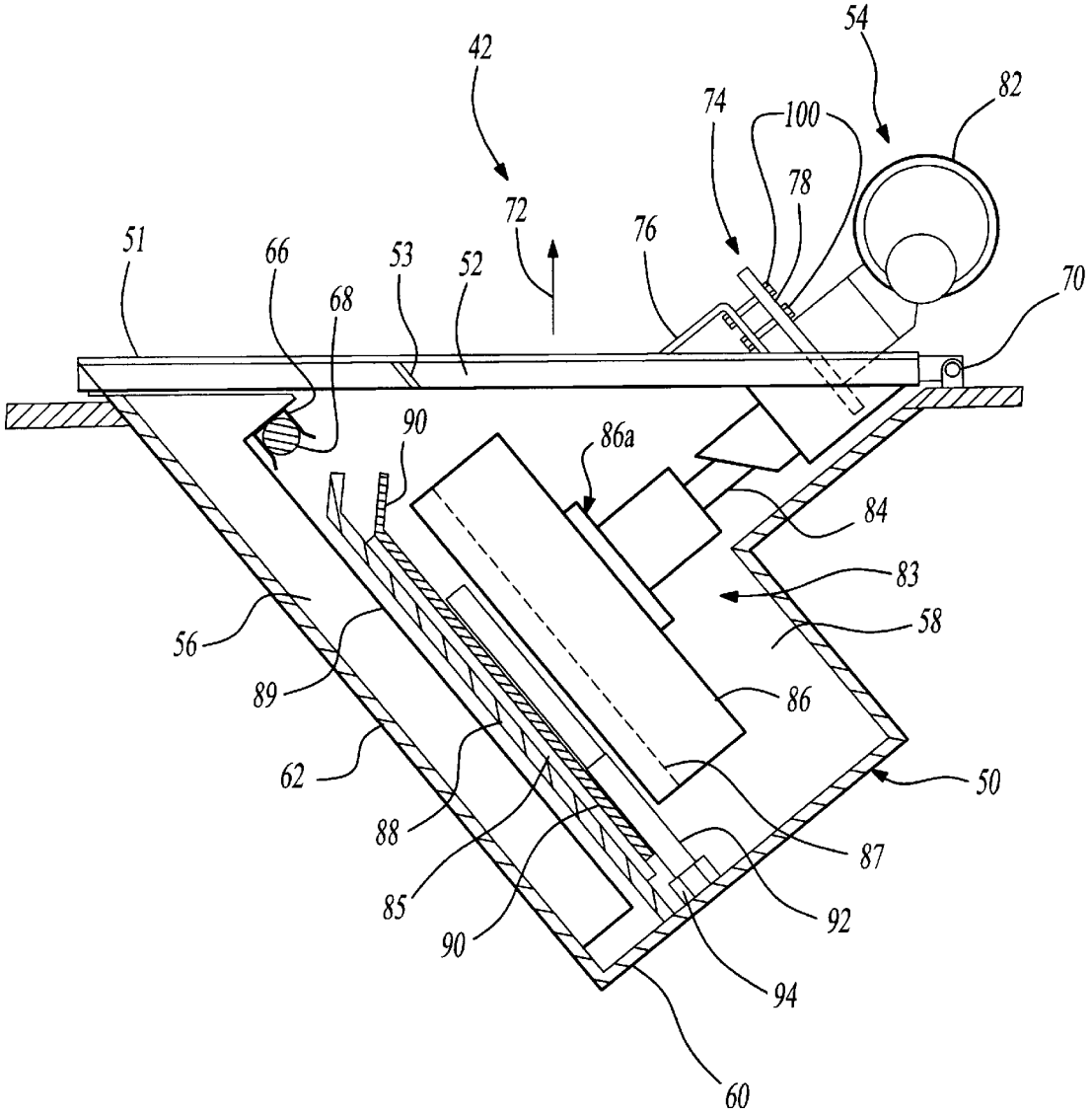
FIG. 3 is a schematic view of a deposition cell having a pivotable and shiftable cover.

FIG. 3 shows a schematic view of the deposition cell 42 according to the invention. The anode container 56, which is filled with nickel material in the form of small pieces called pellets or flats, is arranged within the container 50 which is filled with an electrolyte 58 and whose outer walls, 60 and 62, are inclined at 45° with respect to a vertical line. The anode container 56 is arranged parallel to the outer wall 62 of the container 50. On its top side, the anode container 56 supports a clip connector 66 which is in electrical contact with an anode conductor 68 having a circular cross-section. The clip connector 66 can easily be detached from the anode conductor 68 so that the anode container 56 can be removed from the container 50 by an operator.

The cover 52 is connected to the base of the galvanic machine 40 or to an edge portion of the container 50 by a pivoting means 70. The cover 52 can therefore be lifted in the direction of the arrow 72 for gaining access to the interior of the container 50. An adjusting device 74 is mounted on the cover 52. The adjusting device 74 has an angular plate 76 and an adjusting plate 78 connected to the angular plate 76 by means of adjusting screws 100. The adjusting plate 78 supports the drive means 54 which comprises a motor 82. The motor 82 drives a drive shaft 84 via a transmission gear (not shown). A clamping plate 86 of a substrate holder 86A is mounted to an end of the drive shaft 84. The substrate 87 onto which nickel is to be deposited is clamped onto the clamping plate 86. By adjusting screws 100 of the adjusting device 74, the clamping plate 86 and the substrate 87 can be orientated parallel to the anode container's planar exit surface 89 for nickel ions which is opposite the substrate 87, and the distance between the substrate 87 and the anode container 56 can be precisely adjusted.

A partition wall 88, having a filter element 85, is arranged between the clamping plate 86 and the anode container 56 and is rigidly connected to outer wall 60 of the container 50. The filter element 85 prevents particles or mud of the nickel anode material from entering a aperture (not shown) in a guiding shield 90 lying opposite to the partition wall 88. The guiding shield 90 has a handle portion 90*a* which facilitates its insertion. An injection nozzle 92 is arranged below the guiding shield 90 for injecting the purified electrolyte 58 into the space between the guiding shield 90 and the substrate 87 clamped onto the clamping plate 86. The electrolyte 58 is supplied via a supply pipe schematically indicated at 94. For improved clarity, the required outlet means for the electrolyte 58 is not shown in FIG. 3.

Figure 4:
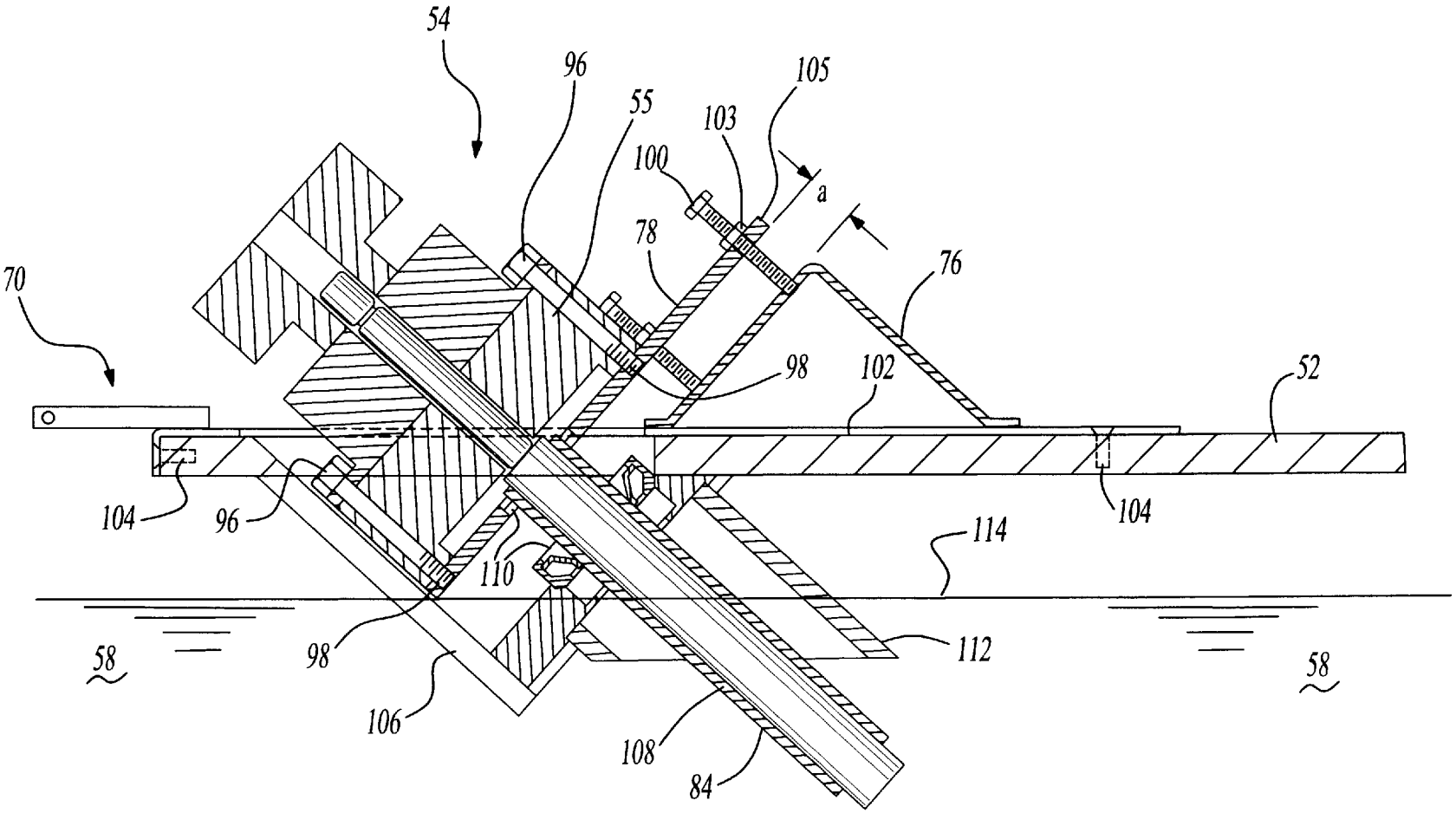
FIG. 4 is a partial cross-sectional view of an adjusting device arranged on the cover and of a driven shaft.
Figure 5:
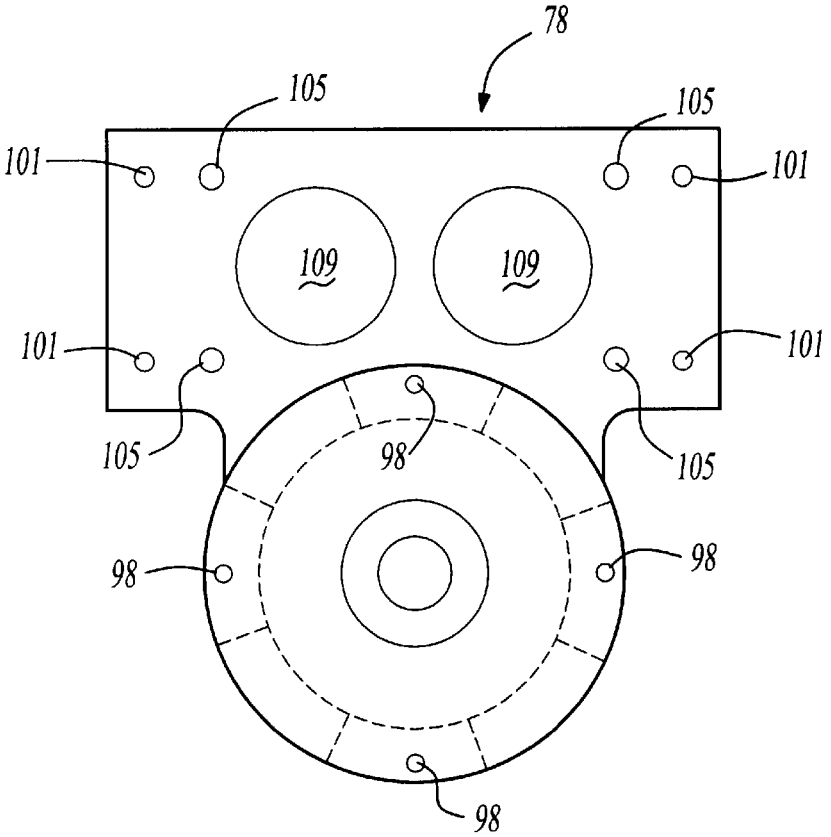
FIG. 5 is a top view of an adjusting plate for adjusting a drive unit and the shaft driven by the drive unit.

FIG. 4 shows a cross-sectional view of the upper portion of the drive means 54 mounted on the cover 52. This upper portion is secured to the adjusting plate 78 by means of screws 96 engaging threaded holes 98. For a better understanding of the arrangement of the connecting members on the adjusting plate 78, reference is made to FIG. 5 showing a top view of the adjusting plate 78. The angular plate 76 is arranged opposite the adjusting plate 78 and is spaced from it by a distance a. The adjusting plate 78 rests on the angular plate 76 by means of adjusting screws 100 (only one of which is shown in FIG. 4). The adjusting screws 100 are guided in threaded bores 101 (best shown in FIG. 5). By turning the respective adjusting screw 100, the angular position and the distance a of the adjusting plate 78 relative to the angular plate 76 can be changed, thereby adjusting the position of the surface of the substrate 87 with respect to the anode container's exit surface 89 facing the substrate 87. The adjusting plate 78 with the drive means 54 is secured to the angular plate 76 by means of screws 103 extending through bores 105 and engaging threaded holes 107. For an improved clarity of the drawings, the through bores 105 are shown only in FIG. 5, while the threaded holes 107 are shown only in FIG. 6.

The angular plate 76 is secured by welding or by means of screws to a solid stainless steel plate 102 which is mounted on the cover 52 by means of screws 104. The stainless steel plate 102 is bent in the proximity of the pivoting means 70 and is secured to the cover 52 by means of screws 104. A drive unit 55 partially penetrates into an oval opening 116 (see FIG. 6) through the cover 52 and the stainless steel plate 102. The drive means 54 is surrounded by a protective cover 106 to protect it from the electrolyte 58. The shaft 84 has an insulating layer 108 and is sealed from the electrolyte 58 by sealing members 110. A protecting tube 112 extends below the upper level 114 of the electrolyte 58 and serves as a protection against splashing during rotation of the shaft 84.

FIG. 5 shows a top view of the adjusting plate 78 with the threaded holes 98 for mounting the drive unit 55, which is shown in FIG. 4. The angular position and the distance of the adjusting plate 78 relative to the angular plate 76 can be adjusted by means of the four screws 100 (shown in FIG. 4) which are guided in the threaded bores 101. The through bores 105 in the adjusting plate 78 which are arranged parallel to and at a small distance from the threaded bores 101 are adapted to receive the four screws 103 (shown in FIG. 4) which rigidly connect the drive means 54 with the angular plate 76. Two recesses 109, 109 are provided for weight reduction.

Figure 6:
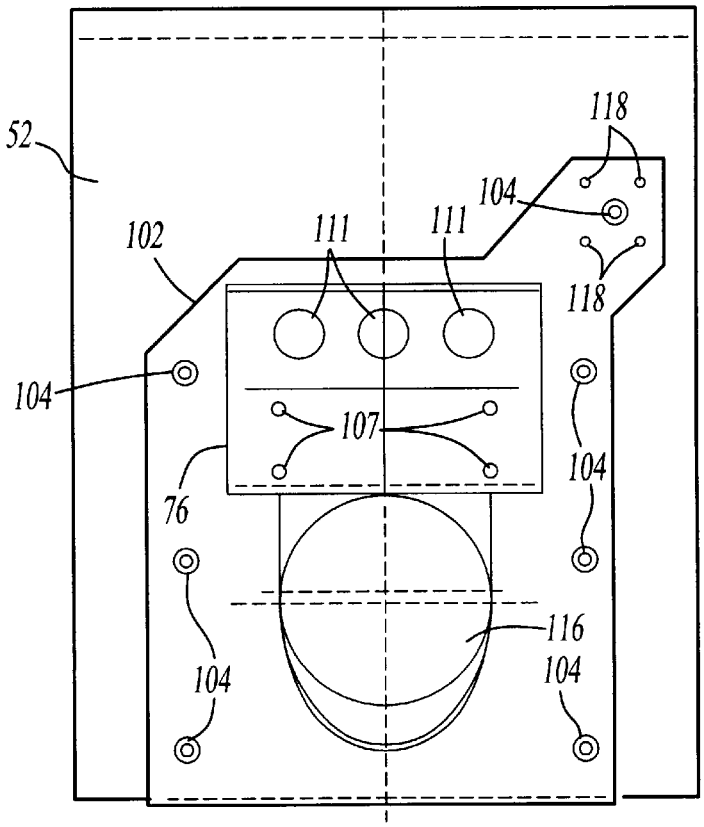
FIG. 6 is a top view of the cover with the drive unit removed.

FIG. 6 shows a top view of the cover 52 with the stainless steel plate 102 and the angular plate 76, but without the drive means 54 and the pivoting means 70 which are both shown installed in FIG. 4. The cover 52 is connected with the stainless steel plate 102 by means of screws 104. The through holes 107 in the angular plate 76 serve for connecting the adjusting plate 78 to the angular plate 76. FIG. 6 clearly shows the oval opening 116 into which the drive means 54 partially penetrates (see FIG. 4). Threaded holes 118 are provided on the upper end of the stainless steel plate 102 for mounting a flange (not shown). A drive (not shown) acts on this flange for opening and closing the cover 52. The recesses 111 in the angular plate 76 are provided for weight reduction.

Figure 7:
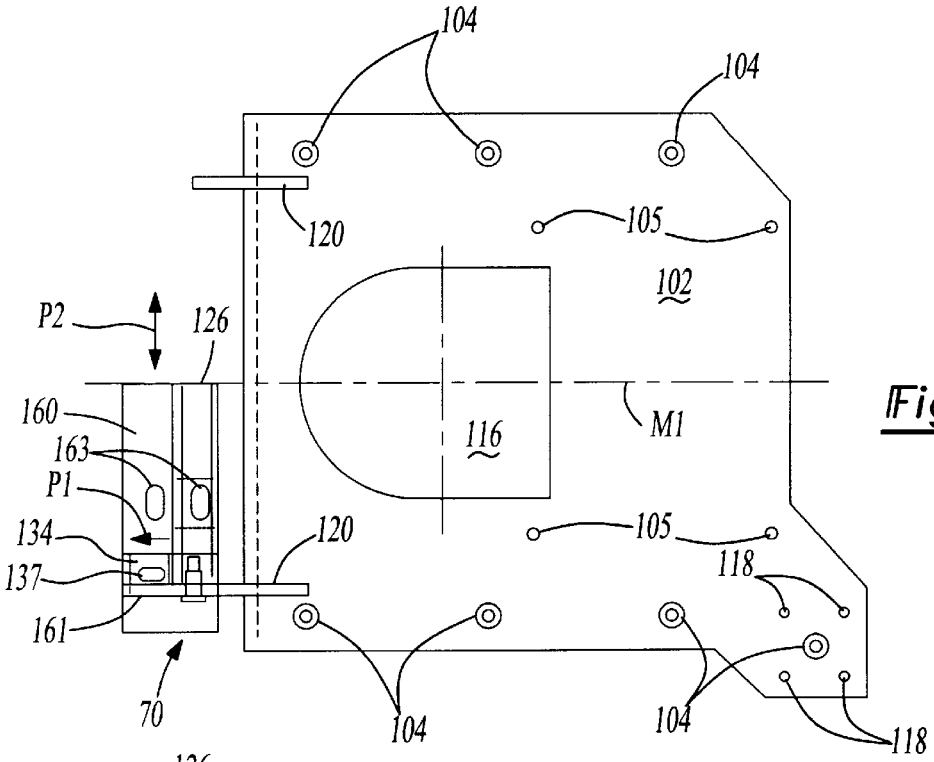
FIG. 7 is top view of a stainless steel plate, which attaches to the cover and has a pivoting means.
Figure 8:
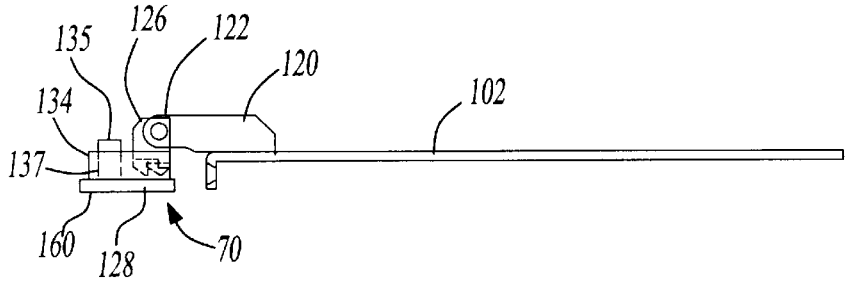
FIG. 8 is a side view of the structure shown in FIG. 7.

FIG. 7 shows the stainless steel plate 102 with the pivoting means 70 attached thereto. Only one half of the pivoting means 70 is illustrated; it is symmetrical with respect to center line M1. The angular plate 76 on the stainless steel plate 102 has been omitted for improving the clarity of the drawing. In this example, the stainless steel plate 102 has threaded holes 105 for attaching the angular plate 76 by means of screws. FIG. 8 shows a side view of the structure according to FIG. 7. The pivoting means 70 has two extension pieces 120 which are welded to the stainless steel plate 102. An upper pivot bearing 122 is formed on each extension piece 120 on the end facing away from the stainless steel plate 102. A spacer member 126 has a first end pivotally arranged in the upper pivot bearing 122 and extends across the entire width between the two extension pieces 120. The spacer member 126 has a lower pivot bearing 128 in a second end pivotally supporting a hinge 134. The hinge 134 is fastened in a groove-like recess 161 on a base plate 160 by a screw 135. The hinge 134 has an elongated hole 137, whereby it is adjustable along the double arrow P1. The base plate 160 also has elongated holes 163 into which screws can be inserted for mounting the plate on the edge of the container 50 or to the frame of the galvanic machine 40. The base plate 160 is thus adjustable in the direction of the double arrow P2.

Figure 9B:
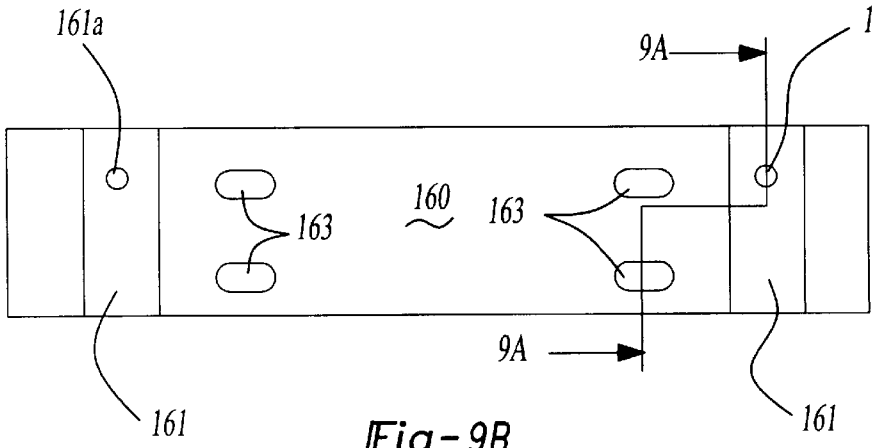
FIG. 9B is a top view of the shiftable base plate shown in FIG. 9A.
Figure 9A:
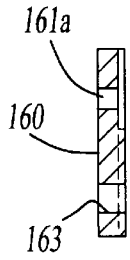
FIG. 9A is a side view of a shiftable base plate of the pivoting means.

FIG. 9A shows a side view and FIG. 9B shows a top view of the base plate 160 having the elongated holes 163. The grooves 161 contain threaded holes 161*a* for mounting the hinges 134 (shown in FIG. 7).

Figure 10:
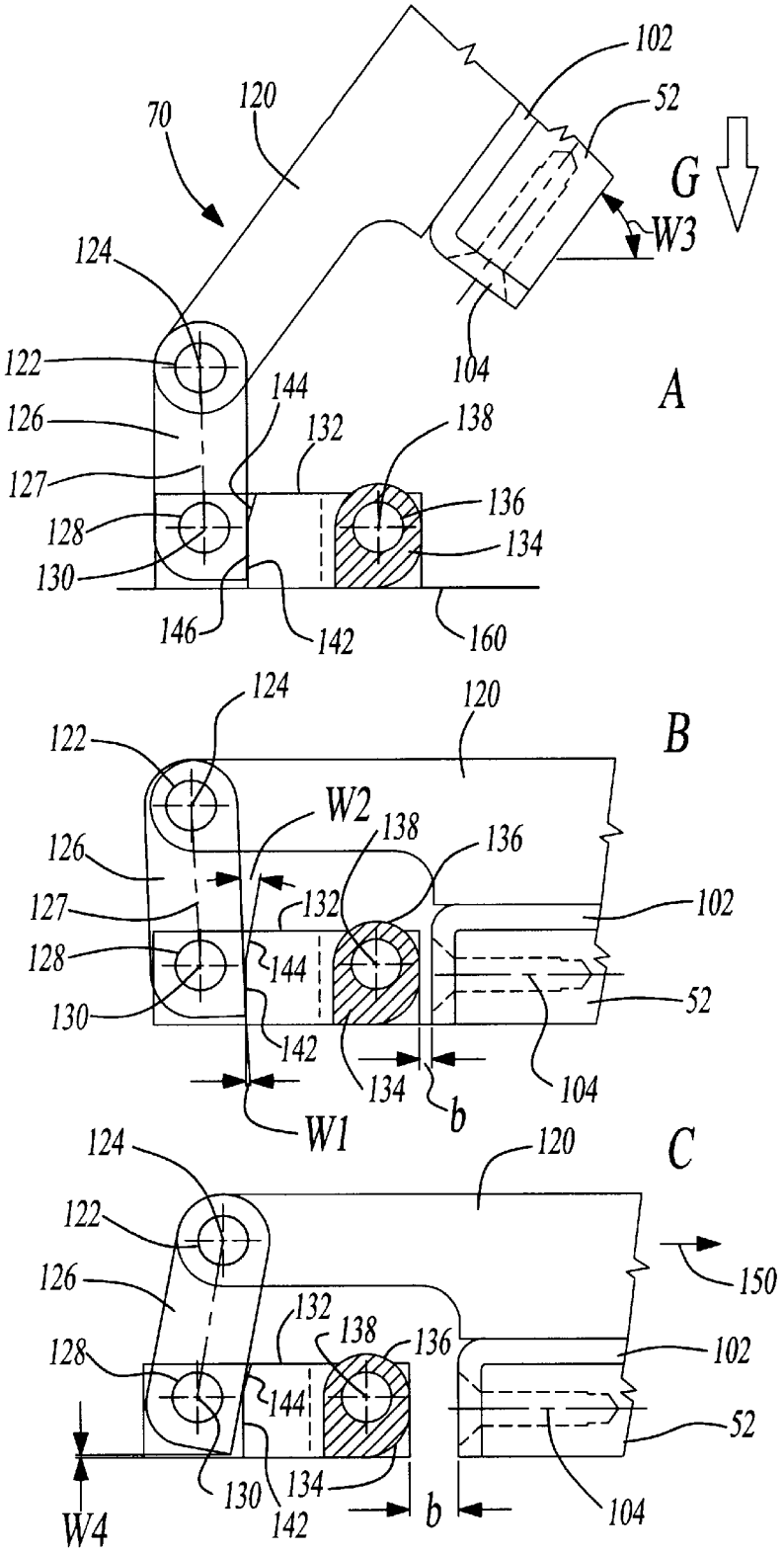
FIGS. 10A–C, show three different operating states of the pivoting means as the cover is moved from an open position to a closed position.

FIG. 10 shows an embodiment of the pivoting means 70 in different operating stages A, B, C between an open position, a closed position, and a shifted position of the cover 52, respectively. The pivoting means 70 is connected to the stainless steel plate 102 by the extension piece 120 which is connected with the spacer member 126 by the upper pivot bearing 122 having a pivoting axis 124. The pivoting axis 124 lies in a plane that is essentially parallel to longitudinal axis of the drive shaft 84 (not shown). By means of the lower pivot bearing 128 having a lower pivoting axis 130, the spacer member 126 is connected with a pivoting lever 132 arranged in the hinge 134. The hinge 134 comprises a pivot bearing 136 having a pivoting axis 138 and is rigidly connected with the base plate 160, which is only suggested in the drawing and which is preferably formed integrally with the edge of the container 50. The pivoting lever 132 has a lower stop face 142 which, together with a vertical line and seen in the counter-clockwise direction, encloses a small acute angle w1 (see stage B). Further, the pivoting lever 132 has an upper inclined stop face 144 which, together with a vertical line and seen in the clockwise direction, encloses a small acute angle w2 (see stage B). The spacer member 126 has corresponding continuous plane first and second stop faces, 146 and 148, respectively, facing the lower stop face 142 and upper inclined stop face 144, respectively.

The operation of the pivoting means 70 is explained below with reference to the operating stages A, B, C. The arrow G in the upper portion of FIG. 10 indicates the direction of gravity, which is the vertical line. In the open position shown as operating stage A (in this example, the included angle w3 is approximately 50°) the first stop face 146 rests against the lower stop face 142. A center line 127 of the spacer member 126 is slightly inclined by the angle wl with respect to the vertical line, so that the first stop face 146 is pressed against the lower stop face 142 because of the weight of the cover 52.

In operating stage B, the closed position, the cover 52 is pivoted about the pivoting axis 124 in the direction of the arrow G, while the first stop face 146 and the lower stop face 142 remain in contact with each other. As a result, a small gap or distance b is present between the front edge of the pivoting lever 132 and the bent stainless steel plate 102.

In the operating stage C, the shifted position, the cover 52 is moved in the direction of the arrow 150 until the second stop face 148 comes into contact with the upper inclined stop face 144. Because the upper inclined stop face 144 is inclined at the angle w2, the pivot bearing 124 moves towards the right, so that the distance b increases. For achieving height adaptation, the pivoting lever 132 rotates in the clockwise direction about the pivoting axis 138 by a small angle w4. Due to the pivoting means 70 arrangement as shown FIG. 7, the distance between the substrate 87 clamped onto the clamping plate 86 and the anode container's exit surface 89 facing the substrate is reduced, thereby accelerating the deposition process. A nickel layer is thus formed on the substrate 87 at a high total current and at a constant applied voltage.

To open the cover 52, the cover 52 is shifted in the opposite direction as arrow 150 (see operating stage B), and the cover 52 is then lifted (operating stage A). The distance between the surface of the clamping plate 86 facing the anode container 56 and the guiding shield 90 (see FIG. 3) is increased by shifting the cover 52 in a direction opposite to the arrow 150, permitting the clamping plate 86 to safely pass the guiding shield 90 when the cover 52 is being opened without any risk of damaging the clamping plate 86 or the guiding shield 90.

Figure 11:
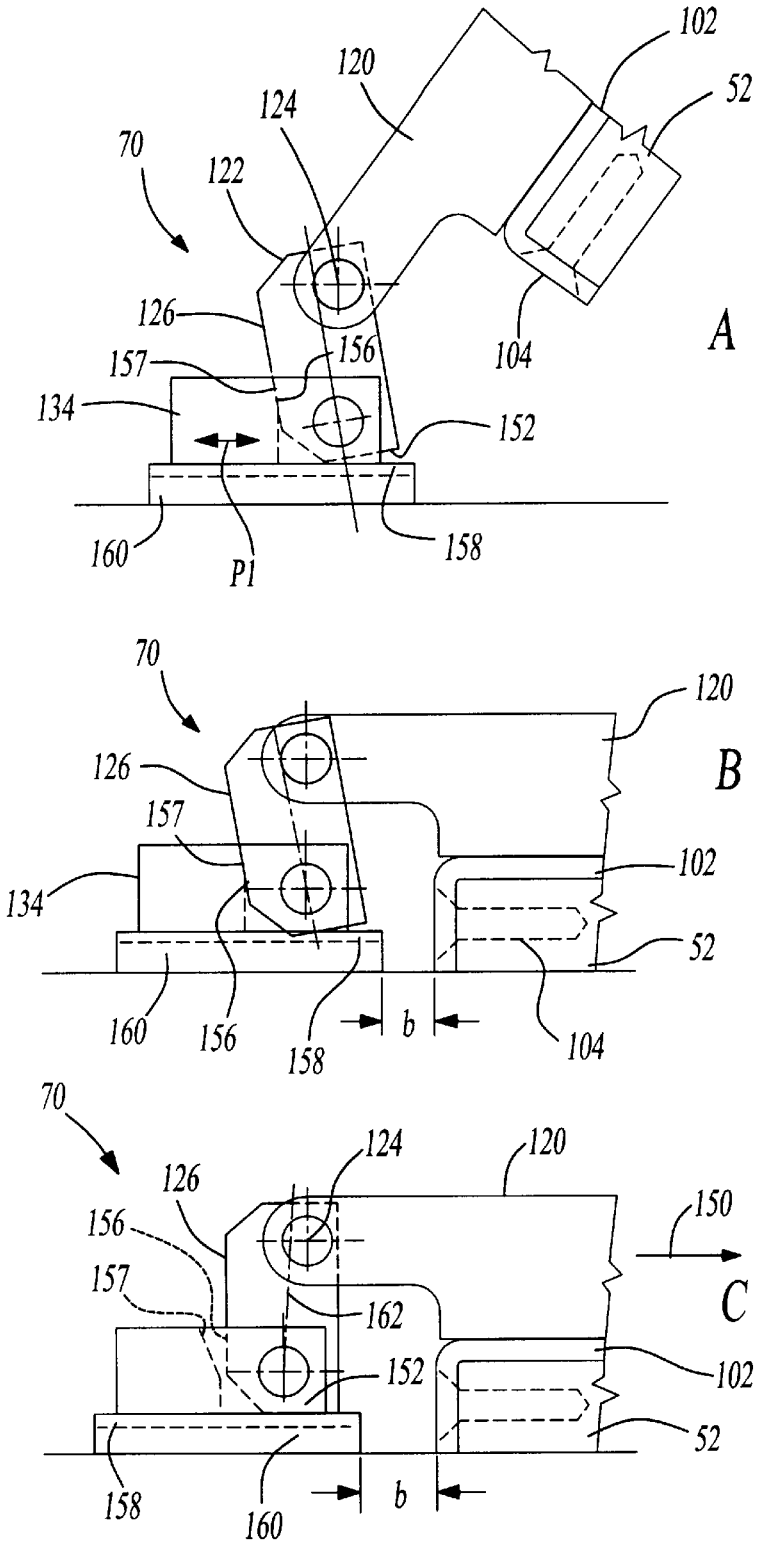
FIGS. 11A–C show another embodiment of the pivoting means in the three different operating stages.

FIG. 11 shows another embodiment of the pivoting means 70 in the different operating stages A, B, C. Like members are identified by like reference numbers. The spacer member 126 has a lower stop face 152 and a rear stop face 156 which rests against an inclined stop face 157 of the hinge in the operating stages A and B. The lower stop face 152 of the spacer member 126 comes into contact with a plane stop face 158 on the base plate 160 in the operating stage C. In the operating stage A, the cover 52 is in the open position, and the rear stop face 156 comes into contact with the inclined stop face 157.

In operating stage B, the cover 52 is in a closed position, while the rear stop face 156 and inclined stop face 157 remain in contact with each other. As a result, a distance b is present between the base plate 160 and the bent stainless steel plate 102. In operating stage C, the cover 52 is shifted in the direction of the arrow 150 so that the lower stop face 152 and the plane stop face 158 cooperate. The distance b is thereby increased.

As can be seen particularly well in operating stage C, the pivoting axis 124 does not lie on the center line 162 of the spacer member 126. As a result, during shifting of the cover 52, the extension piece 120 is slightly lifted along a circular path, whereby the gliding resistance of the cover 52 relative to the container 50 is reduced.

Figure 12:
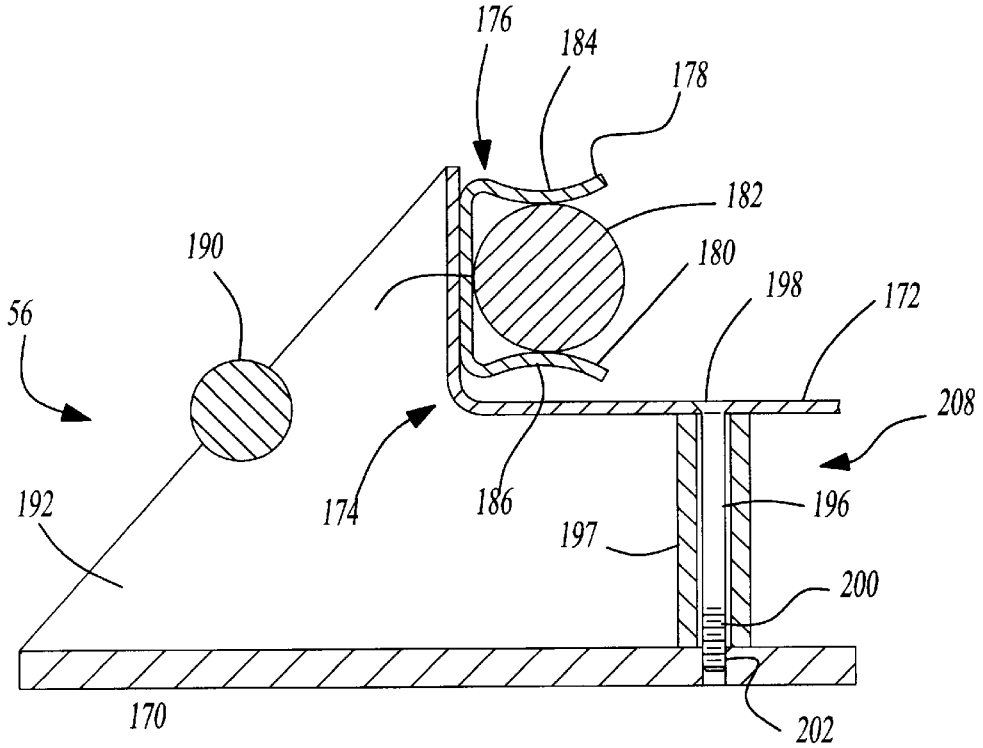
FIG. 12 is a cross-sectional view of an anode container with a clip connector and an anode conductor.

FIG. 12 shows a cross-sectional view of the upper portion of the anode container 56. It is essentially cuboid and has a continuous closed rear wall 170 of titanium of a thickness of approximately 4 mm. This comparatively thick rear wall 170 gives mechanical strength to the anode container 56. In the upper region, which is accessible to an operator, the anode container 56 is open so that it can easily be filled with the nickel pieces. For this purpose, a front wall 172 also made of titanium and having a reduced thickness of 2 mm is bent in the region 174. A U-shaped clip connector 176 is welded to the bottom side of the bent portion of the front wall 172. With its legs 178, 180, the clip connector 176 embraces the anode conductor 182 which is circular in cross-section. The legs 178, 180 are concave and form a funnel-shaped opening at their ends, which facilitates slipping the clip connector 176 onto the anode conductor 182. During this process of slipping the clip connector 176 onto the anode conductor 182, any electrolyte incrustations which may form on the anode conductor 182 are removed. Contact points 184, 186 on the anode conductor 182 and on the legs 178, 180 are scrubbed clean. Another contact point 188 is formed by the base of the clip connector 176. This kind of electric contact between the clip connector 176 and the anode conductor 182 ensures that contact resistance is low, and facilitates the handling of the anode container 56. A handle bar 190 is mounted to the side walls, 192 and 194, (see also FIG. 13) in the region of the opening of the anode container 56. The handle bar 190 can be gripped by an operator for removal and insertion of the anode container 56 into the electrolyte container 50.

FIG. 12 also shows a screw 196 between the front wall 172 and the rear wall 170. A flat head 198 of the screw 196 is flush with the front surface of the front wall 172. The central portion of the screw 196 extends within a spacer sleeve 197 whose ends rest against the front wall 172 and the rear wall 170, respectively. The length between the ends of the spacer sleeve 197 thus defines the distance between the front wall 172 and the rear wall 170. Nickel pieces can be arranged easily around the spacer sleeves 197. A threaded portion 200 of the screw 196 engages a threaded hole 202 in the strong rear wall 170. The screw 196 is part of a spacer 208 which permits the distance and the planeness of the front wall 172 with respect to the rear wall 170 to be adjusted. In this manner, bulges or ripples of the front wall 172 can be compensated for. Preferably, the spacer 208 comprises a plurality of screws 196 made of titanium and spacer sleeves 197 made of titanium. Preferably, the screw heads 198 are arranged on the front wall 172 and corresponding threaded holes 202 are arranged on the rear wall 170. This type of spacer 208 has a simple structure and is easy to realize. In those regions where the front wall 172 including the exit surface 89 tends to become bulged or rippled in operation, the number of screws 196 and spacer sleeves 197 may be larger than in other regions.

Figure 13:
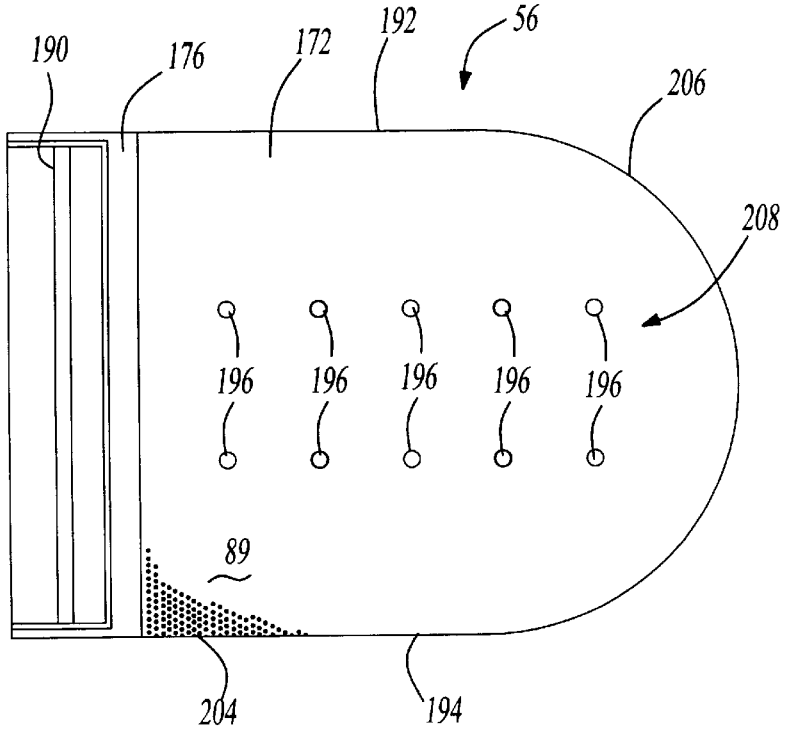
FIG. 13 is a front view of the anode container having a set of titanium screws serving as a spacer means.

FIG. 13 shows a top view of the anode container 56. It can be seen that the clip connector 176 extends across the entire width of the anode container 56 and thus forms a large electric contact surface for the supply of electric power. The front wall 172 and the side walls, 192 and 194 have perforations up to the upper edge of the clip connector 176, as indicated in the margin at 204. The surface of the front wall 172 thus forms the exit surface 89 for the nickel ions leaving the anode container 56. The anode container 56 has a rounded lower portion 206. The arrangement of the screws 196 and the spacer sleeves 197 (shown in FIG. 12) forms the spacer means 208 for maintaining the planeness of the exit surface 89 and its distance from the strong rear wall 170.

The foregoing description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

We claim:

1. An apparatus for the galvanic deposition of a metal layer on a substrate, said apparatus comprising:

a container for holding an electrolyte, an anode container filled with an anode material comprising metal ions, said anode container being in communication with said container and having an essentially planar exit surface for permitting said metal ions of said anode material to be deposited on a surface of said substrate facing said anode container;

said substrate serving as a cathode, said surface of said substrate adapted for inclination with respect to a vertical line and being arranged essentially parallel to and at a distance from said exit surface;

a substrate holder having a clamping plate connected to a drive shaft extending in a direction perpendicular to said surface of said substrate, said drive shaft being supported by a drive means on a cover of said container;

said cover being pivotable between an open and a closed position about a pivoting axis of a pivoting means mounted on a side of said container opposite said anode container; and said surface of said substrate being adjustable relative to said exit surface of said anode container, wherein said cover in its closed position is shiftable towards said anode container thus reducing the distance between said surface of said substrate and said exit surface of said anode container.

2. An apparatus as recited in claim 1, wherein a pivoting axis of said cover lies essentially in a plane that is parallel to the longitudinal axis of said drive shaft and intersects said clamping plate of said substrate holder.

3. An apparatus as recited in claim 1, wherein said pivoting means includes a spacer member, and wherein a pivot bearing includes said pivoting axis and is positioned on a first end of said spacer member, and an opposite second end of said spacer member is connected to a hinge.

4. An apparatus as recited in claim 3, wherein said spacer member has a lower stop face and a rear stop face, said rear stop face contacting an inclined stop face on said hinge when said cover is moved between said closed position and said open position, said lower stop face contacting a plane stop face on a base plate when said cover is at said closed position and while said cover is moved between said closed position and a shifted position.

5. An apparatus as recited in claim 3, wherein said second end of said spacer member is articulated to a pivot bearing of a pivoting lever connected to said hinge.

6. An apparatus as recited in claim 5, wherein said pivoting lever has a lower stop face which cooperates with a first stop face and an upper inclined stop face which cooperates with a second stop face on said spacer member, and wherein said lower stop face and said first stop face cooperate when said cover is being opened and when said cover is in said open position, and wherein said upper inclined stop face and said second stop face cooperate when said cover is in a shifted position.

7. An apparatus as recited in claim 1, wherein said cover supports an adjusting device, said adjusting device permitting said drive shaft to be pivoted about at least one axis.

8. An apparatus as recited in claim 7, wherein said adjusting device supports said drive shaft, said adjusting device pivotable about two axes.

9. An apparatus as recited in claim 7, wherein said adjusting device supports said drive shaft, said drive shaft having a longitudinal axis and said drive shaft movable along said longitudinal axis.

10. An apparatus as recited in claim 7, wherein said adjusting device supports said drive shaft, said adjusting device being shiftable in a plane perpendicular to a longitudinal axis of said drive shaft and said adjusting device being shiftable in a plane parallel to the plane of said cover.

11. An apparatus as recited in claim 1, further comprising an adjusting device having an angular plate connected to an adjusting plate, said angular plate being rigidly connected to said cover, said adjusting plate held apart a distance from said angular plate by a plurality of adjusting screws, said adjusting plate supporting said drive means, and said adjusting screws permitting said adjusting plate to move relative to said angular plate.

12. An apparatus as recited in claim 11, wherein said adjusting plate is positioned in a plane approximately parallel to said exit surface of said anode container, said adjusting plate comprising stainless steel.

13. An apparatus as recited in claim 12, wherein said angular plate comprises an angular shape and said angular plate is rigidly connected to a solid stainless steel plate, said stainless steel plate mounted on said cover.

14. An apparatus as recited in claim 1, further comprising a drive for moving said cover between said open position and said closed position.

15. An apparatus for the galvanic deposition of a metal layer on a substrate, said apparatus comprising:

a container for holding an electrolyte, an anode container comprising titanium and being filled with an anode material comprising metal ions, said anode container being in communication with said container and having an essentially planar exit surface for permitting said metal ions of said anode material to be deposited on a surface of said substrate facing said anode container, said anode container having a spacer means comprising of titanium and arranged between a rear wall and a front wall of said anode container, said spacer means maintaining a predetermined distance between said rear wall and said front wall;

said substrate serving as a cathode, said surface of said adapted for inclination with respect to a vertical line and being arranged essentially parallel to and at a distance from said exit surface;

a substrate holder having a clamping plate connected to a drive shaft extending in a direction perpendicular to said surface of said substrate, said drive shaft being supported by a drive means on a cover of said container;

said cover being pivotable between an open and a closed position about a pivoting axis of a pivoting means mounted on a side of said container opposite said anode container; and said surface of said substrate being adjustable relative to said exit surface of said anode container.

16. An apparatus as recited in claim 15, wherein said spacer means comprises a plurality of screws comprised of titanium, said screws interconnecting said front wall and said rear wall, each of said screws extending through a spacer sleeve comprised of titanium, said spacer sleeves arranged between said front wall and said rear wall.

17. An apparatus for the galvanic deposition of a metal layer on a substrate, said apparatus comprising:

a container for holding an electrolyte, an anode container filled with an anode material comprising metal ions, said anode container being in communication with said container and having an essentially planar exit surface for permitting said metal ions of said anode material to be deposited on a surface of said substrate facing said anode container;

said substrate serving as a cathode, said surface of said adapted for inclination with respect to a vertical line and being arranged essentially parallel to and at a distance from said exit surface;

a substrate holder having a clamping plate connected to a drive shaft extending in a direction perpendicular to said surface of said substrate, said drive shaft being supported by a drive means on a cover of said container;

said cover being pivotable between an open and a closed position about a pivoting axis of a pivoting means mounted on a side of said container opposite said anode container;

said surface of said substrate being adjustable relative to said exit surface of said anode container;

an anode conductor, said anode conductor conducting an anode current;

a contact means positioned on said anode container, said contact means electrically coupled to said anode conductor; and said contact means being a clip connector permitting said contact means to be brought into releasable spring-loaded contact with said anode conductor.

18. An apparatus as recited in claim 17, wherein said clip connector comprises an elastic U-shaped bracket having a pair of legs, said legs contacting said anode conductor and establishing an electrical connection.

19. An apparatus as recited in claim 1, wherein said anode container includes a continuous closed rear wall having a thickness of 3 to 5 mm.

20. An apparatus as recited in claim 1, wherein said exit surface is perforated and has a thickness of 1 to 3 mm.

21. An apparatus for the galvanic deposition of a metal layer on a substrate comprising:

a container for holding an electrolyte, at least one wall of said container being inclined with respect to a vertical line, an anode container made of titanium and filled with an anode material, said anode container being in communication with said container and having an exit surface for ions which are deposited on a substrate surface facing said anode container, said substrate serving as a cathode, the approximately cuboid anode container being arranged such that a rear wall is one of at least approximately parallel to a wall of said container or in contact with said wall; and a titanium spacer arranged between said rear wall and said front wall of said anode container for maintaining a predetermined distance between said rear wall and said front wall.

22. An apparatus according to claim 21, wherein said spacer has a plurality of titanium screws which interconnect said front wall and said rear wall and which extend in titanium spacer sleeves arranged between said front wall and said rear wall, with screw heads preferably arranged on said front wall and associated threaded holes being arranged on said rear wall.

23. An apparatus according to claim 21, wherein said continuous closed rear wall has a thickness of 3 to 5 mm.

24. An apparatus according to claim 21, wherein said front wall is perforated and has a thickness of 1 to 3 mm.

25. An apparatus for the galvanic deposition of a metal layer on a substrate comprising:

a container for holding an electrolyte;

an anode container being in communication with said container, said anode container filled with an anode material and having an essentially planar front wall as an exit surface for metal ions which are deposited on a substrate surface facing said anode container, said substrate serving as a cathode;

an anode conductor for supplying an anode current to said anode container, and a contact means provided on said anode container for establishing an electric connection with said anode conductor; and said contact being designed as a clip connector which can be slipped onto and detached from said anode conductor and which is adapted to be brought into spring-loaded contact with said anode conductor.

26. An apparatus according to claim 25, wherein said anode conductor and said clip connector extends approximately across the entire width of said anode container.

27. An apparatus according to claim 25, wherein said anode conductor is essentially circular in cross-section.

28. An apparatus according to claim 25, wherein said clip connector has an elastic U-shaped bracket with legs which embrace said anode conductor for establishing contact.

29. An apparatus according to claim 28, wherein a base of said U-shaped bracket rests on said anode conductor.

30. An apparatus according to claim 25, wherein said clip connector is arranged on a front wall of said anode container near an opening of said container for holding the electrolyte.

31. An apparatus according to claim 25, wherein a handle bar extends in the direction of the width of said anode container and is arranged in the region of said opening of said anode container.

* * * * *

UNITED STATES PATENT AND TRADEMARK OFFICE

CERTIFICATE OF CORRECTION

PATENT NO : 5,976,329

DATED : Nov. 2, 1999

INVENTOR(S) : Bock, et al.

It is certified that error appears in the above-identified patent and that said Letters Patent is hereby corrected as shown below:

On the Title page of the patent, the following corrections should be made:

Delete "[22] PCT Filed: Oct. 9, 1997"

Insert --[22] PCT Filed: Apr. 1, 1997--

Signed and Sealed this

Twenty-sixth Day of December, 2000

*Attest:*

Q. TODD DICKINSON

*Attesting Officer*

*Director of Patents and Trademarks*